United States Patent [19]

Schmitt

[11] 4,115,288

[45] Sep. 19, 1978

[54] LUBRICANTS CONTAINING SUBSTITUTED TRIAZOLES AS ANTIWEAR AGENTS

[75] Inventor: Kirk D. Schmitt, Pennington, N.J.

[73] Assignee: Mobil Oil Corporation, New York, N.Y.

[21] Appl. No.: 758,113

[22] Filed: Jan. 10, 1977

[51] Int. Cl.[2] ..... C10M 1/32; C10M 3/26; C10M 5/20; C10M 7/30

[52] U.S. Cl. ..... 252/50

[58] Field of Search ..... 252/50; 260/308 A

[56] References Cited

U.S. PATENT DOCUMENTS

| | | | |
|---|---|---|---|
| 2,844,582 | 7/1958 | Raley | 260/308 A |
| 3,663,436 | 5/1972 | Carswell | 252/50 |
| 3,752,764 | 8/1973 | Sullivan | 252/50 |
| 3,790,481 | 2/1974 | Byford et al. | 252/56 S |

OTHER PUBLICATIONS

Birkofer et al; Chemische Berichte, 99, 2512, (1966).
Zefirov, et al, Translation from Zhurnal Organicheskoi Khimii, vol. 6, No. 12, pp. 2596–2600, Dec., 1970.
Messmer, et al, Index Chemicus, vol. 4, #1, 1-15-62.
Zefirov, et al, Translation from Zhurnal Organicheskoi Khimii, vol. 12, #1, pp. 143–149, Jan., 1976.

*Primary Examiner*—Delbert E. Gantz
*Assistant Examiner*—Joan Thierstein
*Attorney, Agent, or Firm*—C. A. Huggett; Henry L. Ehrlich

[57] ABSTRACT

This specification discloses a lubricant composition containing a substituted 1,2,3-triazole as an antiwear agent and new compositions of matter useful as antiwear agents.

8 Claims, No Drawings

LUBRICANTS CONTAINING SUBSTITUTED TRIAZOLES AS ANTIWEAR AGENTS

BACKGROUND OF THE INVENTION

This invention is concerned with a lubricant composition that contains a noncorrosive antiwear agent and new compositions of matter which have utility as antiwear agents.

The performance of lubricant compositions such as mineral oil based and synthetic oil based lubricating oils and greases may be greatly enhanced by the inclusion therein of additives such as antiwear, anticorrosion, and antioxidant agents. For example, it is well known to use benzotriazole and tolyltriazole as antiwear additives for lubricating oils.

In U.S. Pat. No. 3,969,237 there are discussed efforts that have been made to employ benzotriazole in gear oils as a copper corrosion inhibitor. In such applications, it has been found that because of the very limited solubility of benzotriazole in mineral base oils, dissolution of the benzotriazole can only be carried out to a very small extent and only if the benzotriazole is first dissolved in a suitable solvent. In instances where relatively higher concentrations are required, such increased concentration of the benzotriazole in the hydrocarbon medium, is not feasible. The prior art has suggested several methods by which the solubility of benzotriazole can be enhanced. These methods, for the most part, comprise either alkylating the aromatic nucleus of the benzotriazole or incorporating another functional group in this nucleus. Each of these methods, although feasible, was accomplished only with great difficulty and was associated with low yields.

SUMMARY OF THE INVENTION

This invention is directed to a lubricant composition that is comprised of a major amount of a lubricating oil or grease and as an antiwear agent a minor amount of a substituted 1,2,3-triazole characterized by the formula:

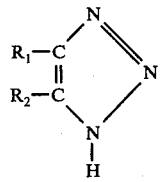

where $R_1$ and $R_2$ are individually selected from the group consisting of an alkyl group containing from 1 to 18 carbon atoms; an aryl group, such as phenyl; hydrogen; and

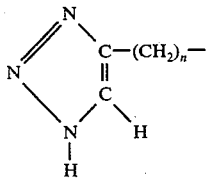

and wherein at least one of $R_1$ and $R_2$ is other than hydrogen and where $n$ is an integer from 5 to 15.

Another aspect of this invention is directed to a composition of matter characterized by the following formula:

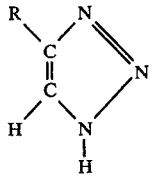

wherein R is an alkyl group having from 1 to 18 carbon atoms or

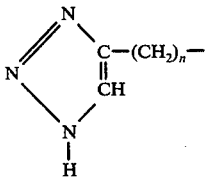

where $n$ is an integer from 5 to 15.

DESCRIPTION OF THE PREFERRED EMBODIMENTS

This invention is directed to a lubricant composition that contains a substituted 1,2,3-triazole as an antiwear compound and new compositions of matter which have utility as antiwear additives. The lubricant composition may be any organic composition such as a lubricating oil or grease having utility for lubricating moving metal parts to prevent or reduce the wear thereof.

As previously mentioned, benzotriazoles have been used as additives for lubricating oils. However, tailoring the structure of benzotriazoles is limited by the availability of o-phenylenediamines of suitable structure. The synthesis of triazoles without fused benzo rings in accordance with this invention as hereafter described relies on the availability of acetylenes, for which a much larger range exists. This invention provides a wide range of compounds that are highly effective as antiwear agents, are noncorrosive, and are easily blended with lubricants.

The lubricant may comprise liquid oils in the form of either a mineral oil or synthetic oil, or in the form of a grease in which any of the oils are employed as a vehicle. In general, mineral oils employed as a lubricant or grease vehicle may be of any suitable lubricating viscosity range, such as, for example, from about 45 SSU at 100° F. to about 6000 SSU at 100° F., and, preferably, from about 50 to about 250 SSU at 210° F. These oils may have viscosity indexes varying from below zero to about 100 or higher. Viscosity indexes from about 70 to about 95 are preferred. The average molecular weights of these oils may range from about 250 to about 800. Where the lubricant is to be employed in the form of a grease, the lubricating oil is generally employed in an amount sufficient to balance the total grease composition, after accounting for the desired quantity of the thickening agent, and other additive components to be included in the grease formulation.

Typical synthetic oils which may be used in conjunction with this invention as lubricating oils or greases include polyisobutylene, polybutenes, hydrogenated polydecenes, polypropylene glycol, polyethylene glycol, trimethylol propane esters, neopentyl and pentaerythritol esters, di(2-ethyl hexyl) sebacate, di(2-ethyl hexyl) adipate, dibutyl phthalate, fluorocarbons, silicate esters, silanes, esters of phosphorous-containing acids, liquid ureas, ferrocene derivatives, hydrogenated mineral oils, chain-type polyphenyls, siloxanes and silicones (polysiloxanes), alkyl-substituted diphenyl ethers typified by a butyl-substituted bis (p-phenoxy phenyl) ether, and phenoxy phenyl ethers.

In accordance with this invention, there is provided a lubricant composition that is comprised of a major amount of a lubricating oil or grease and a minor but sufficient amount of an antiwear compound to provide improved antiwear properties to the lubricant composition. Generally, the amount of antiwear compound described hereinabove will be present in the lubricant composition in an amount between about 0.001 and about 5 weight percent.

The antiwear compound is a substituted 1,2,3-triazole. The triazole compound may be a substituted triazole with alkyl substituents having from 1 to 18 carbon atoms or aryl groups. Representative substituted triazoles which have been tested as described below and found to impart good antiwear properties to lubricants when incorporated therein are 4-phenyl-1,2,3-triazole, 4-methyl-5-phenyl-1,2,3-triazole, 4-pentyl-1,2,3-triazole, and 4-heptyl-1,2,3-triazole. Of these the 4-pentyl-1,2,3-triazole and the 4-heptyl-1,2,3-traizole are considered to be new compositions of matter.

In addition, another new composition of matter which I have discovered and which imparts exceptionally good antiwear properties to a lubricant when incorporated therein is bis-1,5-(4-1,2,3-triazolyl)-pentane.

This invention and the improved antiwear properties which may be imparted to a lubricant in accordance therewith are further illustrated by the following data and examples.

The triazoles used in the following-described tests were prepared by 1,3-dipolar addition of trimethylsilylazide to an acetylene or diyne as described by Birkofer and Wegner in *Chemische Berichte,* 99, 2512 (1966) according to the following generalized equation:

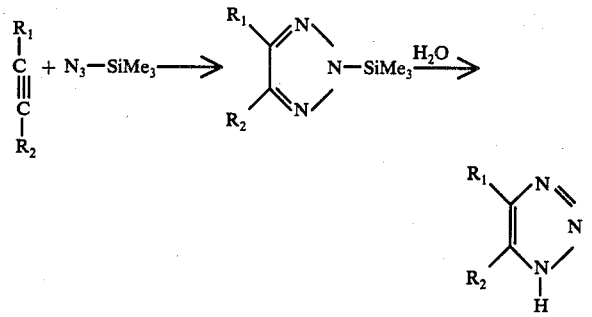

wherein $R_1$ and $R_2$ are individually selected from the group consisting of an alkyl group containing from 1 to 18 carbon atoms; an aryl group, such as phenyl; hydrogen; and

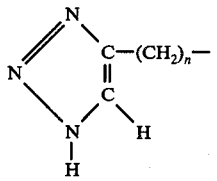

and wherein at least one of $R_1$ and $R_2$ is other than hydrogen and where $n$ is an integer from 5 to 15.

EXAMPLE 1

Preparation of 4-methyl-5-phenyl-1,2,3-triazole.

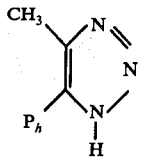

1-Phenyl-1-propyne (2.52 g) and azidotrimethylsilane (2.48 g, $Me_3SiN_3$) were sealed into a heavy-walled glass reactor at −70° C. and 0.5 mm Hg. The mixture was heated 11 days at 155° C., cooled, dissolved in diethyl ether ($Et_2O$), and stirred briefly with 5 percent HCl. After washing with a small amount of $NaHCO_3$ solution, the $Et_2O$ solution was evaported to give 3.06 g (89%) cream white solid, mp 173.5–174.0 whose NMR spectrum and elemental analysis confirm its structure.

| Chemical Shift | Description | Integral | Assignment |
|---|---|---|---|
| 13.5 ppm | broad | 0.44 H | NH |
| 7.2–7.6 ppm | multiplet | 5.1 | Ph |
| 2.4 ppm | singlet | 2.9 | $CH_3$ |
| Calcd. for $C_9H_9N_3$: | C, 67.90 | | |
| | H, 5.70 | | |
| | N, 26.40 | | |
| Found: | C, 67.95 | | |
| | H, 5.67 | | |
| | N, 26.43 | | |

EXAMPLE 2

Preparation of 4-n-heptyl-1,2,3-triazole.

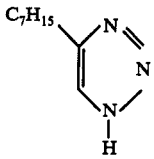

1-Nonyne (5.0 g) and $Me_3SiN_3$ (6.2 g) were sealed into a heavy-walled glass reactor at −70° C. and 0.6 mm Hg. The mixture was heated at 150° C. for 34 hours, cooled and dissolved in $Et_2O$. The $Et_2O$ solution was washed successively with 5 percent aq. HCl, 7 percent aq. $NaHCO_3$, saturated aq. NaCl, dried over $MgSO_4$, filtered and distilled to give 3.89 g (58%) pale yellow oil, bp 110–130/0.05 mm whose NMR spectrum and elemental analysis confirm its structure.

| Chemical Shift | Description | Integral | Assignment |
|---|---|---|---|
| 13.5 ppm | broad | 0.85 H | NH |
| 7.5 ppm | singlet | 0.86 | C=C—H |
| 2.8 ppm | triplet | 1.9 | $—CH_2—C=$ |
| 0.7–2.0 ppm | triplet & envelope | 13.4 | $C_6H_{13}—$ |
| Calcd. for $C_9H_{17}N_3$: | C, 64.63 | | |
| | H, 10.25 | | |
| | N, 25.12 | | |
| Found: | C, 64.74 | | |
| | H, 10.26 | | |
| | N, 24.97 | | |

EXAMPLE 3

Preparation of 4-phenyl-1,2,3-triazole.

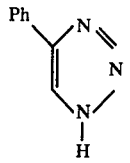

Phenylethyne (12.0 g) and $Me_3SiN_3$ (7.8 g) were sealed into a heavy-walled glass reactor at −70° C. and 0.6 mm Hg. The mixture was heated at 150° C. for 10 hrs., cooled, and dissolved in $Et_2O$. The $Et_2O$ was treated exactly as in Example 2, reduced to 100 ml total volume, a little hexane added and chilled in a refrigerator overnight. Filtration gave 7.5 g (76%) white crystals mp 146.9–149.0.

EXAMPLE 4

Preparation of 4-n-pentyl-1,2,3-triazole.

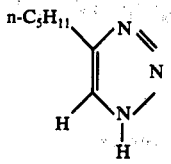

1-heptyne (9.6 g) and $Me_3SiN_3$ (7.8 g) were sealed into a heavy-walled glass reactor at −70° C. and 0.6 mm Hg. The mixture was heated at 155° C. for 48 hrs., cooled and dissolved in $Et_2O$. The $Et_2O$ was treated exactly as in Example 2. The product was distilled, bp 89–94/0.2 mm to give 7.2 g (76%) water white liquid whose NMR spectrum and elemental analysis confirm its structure.

| Chemical Shift | Description | Integral | Assignment |
|---|---|---|---|
| 14.2 ppm | broad | 0.84 H | NH |
| 7.6 ppm | singlet | 0.93 | C=CH |
| 2.8 ppm | triplet | 2.0 | $ArCH_2$ |
| 1.2–2.0 ppm | multiplet | 6.3 | $—(CH_2)_3—$ |
| 0.9 ppm | triplet | 3.0 | $CH_3—$ |
| Calcd. for $C_7H_{13}N_3$: | C, 60.40 | | |
| | H, 9.41 | | |
| | N, 30.19 | | |
| Found: | C, 60.64 | | |
| | H, 9.41 | | |
| | N, 30.12 | | |

EXAMPLE 5

Preparation of bis-1,5-(4-1,2,3-triazolyl)-pentane.

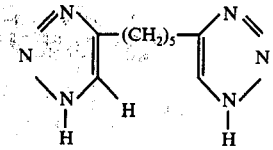

1,5-Nonadiyne (6.0 g) and $Me_3SiN_3$ (18.0 g) were sealed into a heavy-walled glass reactor at −70° C. and 0.5 mm Hg. The mixture was heated at 150° C. for 72 hrs., cooled and dissolved in a mixture of 200 ml $Et_2O$ + 100 ml tetrahydrofuran (THF). The mixture was treated as in Example 2 and the solvents evaporated in vacuo. The residue was triturated with a boiling mixture of hexane and heptane to give 6.4 g (62%) white solid, mp 104.5–106.0, whose NMR spectrum and elemental analysis confirm its structure.

| Chemical Shift | Description | Integral | Assignment |
|---|---|---|---|
| 15 ppm | broad | 1.8 H | NH, NH |
| 7.8 ppm | singlet | 1.8 | C=CH, C=CH |
| 2.8 ppm | triplet | 4.0 | $CH_2Ar$, $CH_2Ar$ |
| 1.2–2.3 ppm | multiplet | 6.4 | $—(CH_2)_3—$ |
| Calcd. for $C_9H_{14}N_6$: | C, 52.41 | | |
| | H, 6.84 | | |
| | N, 40.75 | | |
| Found: | C, 52.80 | | |
| | H, 7.13 | | |
| | N, 40.40 | | |

The compositions of Examples 1–5 were added to a base stock oil and tested for antiwear activity using the Four-Ball Wear Test as disclosed in U.S. Pat. No. 3,423,316. In general, in this test three steel balls of SAE 52100 steel are held in a ball cup. A fourth ball positioned on a rotatable vertical axis is brought into contact with the three balls and is rotated against them. The force with which the fourth is held against the three stationary balls may be varied according to a desired load. The test lubricant is added to the ball cup and acts as a lubricant for the rotation. At the end of the test the steel balls are investigated for wear scar; the extent of scarring represents the effectiveness of the lubricant as an antiwear agent. Results are also reported as wear rates in volume of wear per unit sliding distance per kilogram load. The lower the wear rate, the more effective the lubricant as an antiwear agent. The base stock oil employed in accordance with the test results shown in Table I comprised a 150 SSU at 210° F. solvent-refined paraffinic bright stock lubricating oil. In the data summarized in Table I, all additives were tested at concentrations of 0.1 percent wt. Standard conditions of 40 Kg load, 600 rpm, and 30 minutes' test time were employed at 200° F. and 400° F.

Table 1

Four Ball Wear Test Results
40 Kg load, 600 RPM, 30 min.

| 200° F. Additive | Coefficient of Friction | Wear Scar Diameter mm | Wear Rate $\times 10^{12}$ cc/Kg-cm |
|---|---|---|---|
| None | — | 0.6858 | 4.6 |
| Example 1 - 4-methyl-5-phenyl-1,2,3-triazole | 0.0872 | 0.3769 | 0.23 |
| Example 2 - 4-n-heptyl-1-1,2,3-triazole | 0.0928 | 0.3988 | 0.33 |
| Example 3 - 4-phenyl-1,2,3-triazole | 0.0838 | 0.3734 | 0.22 |
| Example 4 - 4-n-pentyl-1,2,3,-triazole | 0.0895 | 0.4318 | 0.53 |
| Example 5 - bis-1,5-(4-1,2,1-triazolyl)-pentane | 0.0926 | 0.3480 | 0.12 |
| 400° F. | | | |
| None | 0.1593 | 0.8341 | 10.5 |
| Example 1 | 0.1034 | 0.7112 | 5.37 |
| Example 2 | 0.1252 | 0.7189 | 5.62 |
| Example 3 | 0.1219 | 0.5537 | 1.80 |

Table 1-continued

| Four Ball Wear Test Results 40 Kg load, 600 RPM, 30 min. | | | |
|---|---|---|---|
| 200° F. Additive | Coefficient of Friction | Wear Scar Diameter mm | Wear Rate $\times 10^{12}$ cc/Kg-cm |
| Example 4 | 0.1309 | 0.8087 | 9.21 |
| Example 5 | 0.0872 | 0.3988 | 0.33 |

As shown in Table I, the compounds of Examples 1–5 dramatically reduce wear in steel-on-steel at 200° F. The addition of 0.1 percent of these compounds reduces the wear rate to 3–12 percent of the untreated oil. The compounds of Examples 3 and 5 have similar dramatic effects at 400 F.; while those of Examples 1, 2, and 4 reduce wear significantly at that temperature.

Table II compares the wear rates at 200° F. and 400° F. (same conditions) for the compounds of Examples 1 and 3 to the analogous benzo-fused compounds tolyltriazole and benzotriazole at the same 0.1 percent weight concentration.

Table II

| Compound | Wear Rate $\times 10^{12}$ 200° F. cc/cm-Kg | Wear Rate $\times 10^{12}$ 400° F. cc/cm-Kg |
|---|---|---|
| 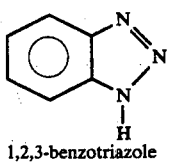 1,2,3-benzotriazole | 0.45 | 5.25 |
| 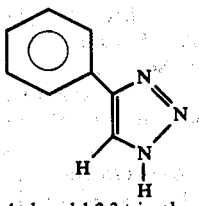 4-phenyl-1,2,3-triazole | 0.22 | 1.80 |
| 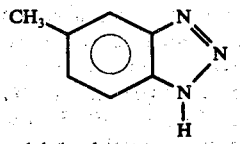 tolyltriazole | 0.41 | 7.18 |
| 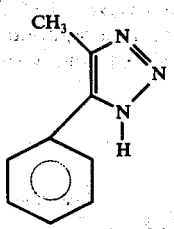 4-methyl-5-phenyl-1,2,3-triazole | 0.123 | 5.37 |

In each case the compound of this invention performed better than its benzo-fused analog.

The alkyltriazoles such as 4-pentyl and 4-heptyl-1,2,3-triazoles have the added advantage of being oil miscible liquids.

I claim:

1. A lubricant composition comprising a major amount of a lubricant base constituting an oil of lubricating viscosity or greases thereof and a minor amount sufficient to impart improved antiwear properties to the lubricant composition of a 1,2,3-substituted triazole characterized by the formula:

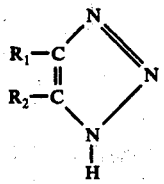

where $R_1$ and $R_2$ are individually selected from the group consisting of an alkyl group containing from 1 to 18 carbon atoms; an aryl group; hydrogen; and

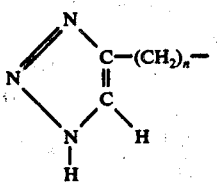

and wherein at least one of $R_1$ and $R_2$ is other than hydrogen and where $n$ is an integer from 5 to 15.

2. The composition of claim 1 wherein said 1,2,3-substituted triazole is an alkyl substituted triazole, the alkyl substituent of which contains from 1 to 18 carbon atoms.

3. The composition of claim 1 wherein said 1,2,3-substituted triazole is an aryl substituted triazole.

4. The composition of claim 1 wherein said substituted triazole is 4-phenyl-1,2,3-triazole.

5. The composition of claim 1 wherein said substituted triazole is 4-methyl-5-phenyl-1,2,3-triazole.

6. The composition of claim 1 wherein said substituted triazole is 4-pentyl-1,2,3-triazole.

7. The composition of claim 1 wherein said substituted triazole is 4-heptyl-1,2,3-triazole.

8. The composition of claim 1 wherein said substituted triazole is bis-1,5-(4-1,2,3-triazolyl)-pentane.

* * * * *